US011672056B2

(12) United States Patent
Sim et al.

(10) Patent No.: US 11,672,056 B2
(45) Date of Patent: Jun. 6, 2023

(54) INDUCTION HEATING DEVICE HAVING IMPROVED COOLING STRUCTURE

(71) Applicant: LG Electronics Inc., Seoul (KR)

(72) Inventors: Hoon Seob Sim, Seoul (KR); Jaekyung Yang, Seoul (KR); Se Mi Lee, Seoul (KR); Yongsoo Lee, Seoul (KR); Hakjoo Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 1210 days.

(21) Appl. No.: 16/182,780

(22) Filed: Nov. 7, 2018

(65) Prior Publication Data

US 2019/0297689 A1 Sep. 26, 2019

(30) Foreign Application Priority Data

Mar. 23, 2018 (KR) ..... 10-2018-0034068

(51) Int. Cl.
*H05B 6/42* (2006.01)
*F04D 13/06* (2006.01)
(Continued)

(52) U.S. Cl.
CPC ..... *H05B 6/42* (2013.01); *F04D 13/06* (2013.01); *F04D 29/60* (2013.01); *F24C 15/101* (2013.01);
(Continued)

(58) Field of Classification Search
CPC ..... H05B 6/1263; H05B 2206/022; H05B 2213/03; H05B 6/1218; H05B 6/1272;
(Continued)

(56) References Cited

U.S. PATENT DOCUMENTS

2006/0049177 A1* 3/2006 Park ..... H05B 6/1263 219/622
2008/0185376 A1* 8/2008 Gagas ..... H05B 6/1263 219/623
(Continued)

FOREIGN PATENT DOCUMENTS

EP 1601236 A2 * 11/2005 ..... F24C 15/006
EP 1628506 2/2006
(Continued)

OTHER PUBLICATIONS

English Translation WO 2008064993 A1 (Year: 2008).*
(Continued)

*Primary Examiner* — Tu B Hoang
*Assistant Examiner* — Vy T Nguyen
(74) *Attorney, Agent, or Firm* — Fish & Richardson P.C.

(57) ABSTRACT

An induction heating device includes a casing; a first induction heating module in the casing; a first heat sink located below the first induction heating module; a first heat pipe that passes through the first heat sink, that extends outward from the first induction heating module, and that is configured to discharge heat from the first heat sink out of the first induction heating module; an air-discharge fan located at an inner side of the casing and configured to discharge air from inside of the casing to outside of the casing; and a cooling fan located at the inner side of the casing and configured to blow air to the air-discharge fan. The first heat pipe has an
(Continued)

RELATED ART end that protrudes from the first induction heating module and that is located at an air-flow path defined between the cooling fan and the air-discharge fan.

19 Claims, 7 Drawing Sheets

(51) Int. Cl.
*F04D 29/60* (2006.01)
*F28D 15/02* (2006.01)
*F24C 15/10* (2006.01)
*H05B 6/12* (2006.01)

(52) U.S. Cl.
CPC ..... *F28D 15/0275* (2013.01); *H05B 6/1263* (2013.01); *H05B 2213/03* (2013.01)

(58) Field of Classification Search
CPC ..... H05K 7/20872; H05K 7/20927; F24C 15/006
USPC ..... 219/623, 622, 677, 452.11, 620, 445; 363/141; 701/22; 126/1 R
See application file for complete search history.

(56) References Cited

U.S. PATENT DOCUMENTS

| | | | | |
|---|---|---|---|---|
| 2012/0118281 | A1* | 5/2012 | Shigeoka | H05B 6/1218 126/1 R |
| 2017/0127480 | A1* | 5/2017 | Hadoulias | F24H 3/022 |

FOREIGN PATENT DOCUMENTS

| | | | | |
|---|---|---|---|---|
| EP | 3177108 | | 6/2017 | |
| JP | 2002299026 | | 10/2002 | |
| JP | 2009295411 | | 12/2009 | |
| JP | 2011233304 | | 11/2011 | |
| JP | 2011253805 | | 12/2011 | |
| WO | WO-2007029502 | A1 * | 3/2007 | H05B 6/1263 |
| WO | WO2008064993 | | 6/2008 | |
| WO | WO-2008064993 | A1 * | 6/2008 | H05B 6/1263 |

OTHER PUBLICATIONS

English Translation EP 1601236 A2 (Year: 2005).*
Extended European Search Report in European Application No. 18205105.2, dated May 17, 2019, 5 pages.

* cited by examiner

INDUCTION HEATING DEVICE HAVING IMPROVED COOLING STRUCTURE

CROSS-REFERENCE TO RELATED APPLICATIONS

This application claims the priority of Korean Patent Application No. 10-2018-0034068, filed on Mar. 23, 2018, in the Korean Intellectual Property Office, the disclosure of which is hereby incorporated by reference in its entirety.

FIELD

The present disclosure relates to an induction heating device having an improved cooling structure.

BACKGROUND

Cooking devices may use various heating methods to heat food. For example, gas ranges may use gas as fuel. In some examples, cooking devices may heat a loaded object such as a cooking vessel or a pot using electricity.

Various methods of heating a loaded object using electricity may be divided into a resistive heating type and an inductive heating type. In the electrical resistive heating method, heat may be generated based on current flowing through a metal resistance wire or a non-metallic heating element such as silicon carbide. In this method, heat may be transmitted to the loaded object through radiation or conduction to heat the loaded object. In the inductive heating method, an eddy current may be generated in the loaded object made of metal based on a high-frequency power of a predetermined magnitude applied to a working coil. In this method, the loaded object may be heated by the eddy current generated based on a magnetic field around the working coil.

For example, the induction heating method may be performed as follows. When power is applied to the induction heating device, a high-frequency voltage of a predetermined magnitude is applied to the working coil. As a result, an inductive magnetic field is generated around the working coil disposed in the induction heating device. When the flux of the inductive magnetic field passes through a bottom of the loaded object containing the metal loaded on the induction heating device, an eddy current is generated inside of the bottom of the loaded object. When the resulting eddy current flows in the bottom of the loaded object, the loaded object itself is heated.

In some cases, an induction heating device may include a plurality of working coils, each working coil corresponding to a heating region to heat one of a plurality of loaded-objects (e.g., a cooking vessel).

In some cases, an induction heating device may heat a single object using a plurality of working coils simultaneously. This device may be referred to as a zone-free based induction heating device.

In some cases of the zone-free based induction heating device, the loaded-object may be inductively heated in a heating zone corresponding to a plurality of working coils, regardless of a size and loaded position of the loaded-object.

FIG. 1 illustrates an example zone-free based inductive-heating device in related art.

As shown in FIG. 1, a plurality of working coils (for example, AWC1 to AWC6, BWC1 to BWC4, and CWC1 to CWC6) are uniformly distributed in the zone-free based induction heating device 10. Thus, the loaded-object thereon may be inductively heated with the plurality of working coils irrespective of the size and position of the loaded-object.

In some cases, in the zone-free based induction heating device 10, the heating region may be divided into a plurality of heating sub-regions. These sub-regions include, for example, an A sub-region AR, a B sub-region BR, and a C sub-region CR. Each sub-region may include a plurality of working coils. For example, the A sub-region AR, the B sub-region BR, and the C sub-region CR have, respectively, a group of six working coils AWC1 to AWC6, a group of four working coils BWC1 to BWC4, and a group of six working coils CWC1 to CWC6. In some examples, an inverter that controls the working coils in a corresponding sub-region may be provided on a sub-region basis. In this case, it may be difficult to independently control each working coil in each sub-region.

In some cases where the zone-free based induction heating device 10 includes a plurality of working coils, the zone-free based induction heating device 10 may include a plurality of inverters for applying resonant current to the working coils. In some cases, the zone-free based induction heating device 10 may include a plurality of switching elements such as insulated gate bipolar transistors (IGBTs) for the plurality of inverters.

In some examples, the zone-free based induction heating device 10 may include the plurality of IGBTs. In some cases, heat may be generation from the IGBTs, which results in heat generation from the device 10.

In some examples, the zone-free based induction heating device 10 may include cooling fans to cool the IGBTs. In some examples, more cooling fans may be provided as the number of IGBTs increases. In some cases, it may be difficult to secure a space for installing the cooling fans in the device 10.

In some examples where an induction heating device is a built-in type product, an installation position of the cooling fans may be restricted due to a height of the device.

SUMMARY

One purpose of the present disclosure is to provide an induction heating device, in which each working coil has a modular structure so that each of a plurality of working coils may be independently controlled.

Another purpose of the present disclosure is to provide an induction heating device in which a plurality of IGBTs may be efficiently cooled.

Still another purpose of the present disclosure is to provide an induction heating device to allow reducing the number of cooling-fans.

According to one aspect of the subject matter described in this application, an induction heating device includes: a casing; a first induction heating module located within the casing; a first heat sink located vertically below the first induction heating module and configured to dissipate heat from the first induction heating module; a first heat pipe that passes through the first heat sink, that extends outward from the first induction heating module, and that is configured to discharge heat from the first heat sink out of the first induction heating module; an air-discharge fan located at an inner side of the casing and configured to discharge air from inside of the casing to outside of the casing; and a cooling fan located at the inner side of the casing and configured to blow air to the air-discharge fan, where the cooling fan is spaced apart from the air-discharge fan at the inner side. The first heat pipe has an end that protrudes from the first induction heating module and that is located at an air-flow path defined between the cooling fan and the air-discharge fan.

Implementations according this aspect may include one or more of the following features. For example, the first heat sink may include thermal grease. In some examples, the first induction heating module includes: a working coil; a first switching element and a second switching element that are located vertically above the first heat sink and that are configured to allow the working coil to receive a resonant current; and an inverter that is configured to apply the resonant current to the working coil based on switching operations of the first switching element and the second switching element. In some examples, each of the first switching element and the second switching element includes an insulated gate bipolar transistor (IGBT).

In some implementations, the first induction heating module includes: a light emitting module that is located outside of the working coil, that is configured to indicate whether the working coil is driven, and that is configured to indicate an output intensity of the working coil; and a control unit configured to control the inverter and the light emitting module. In some implementations, the first heat sink is configured to transfer heat generated from the first induction heating module to the first heat pipe, and the cooling fan is configured to cool heat transferred to the first heat pipe.

In some implementations, the induction heating device may further include a blowing-guide located between the air-discharge fan and the cooling fan, where the blowing-guide defines the air-flow path. In some implementations, the induction heating device may further include: a second induction heating module located within the casing, where the first induction heating module and the second induction heating module are arranged in a first direction; and a second heat sink located vertically below the second induction heating module and configured to discharge heat from the second induction heating module. In some examples, the first heat pipe extends to the second heat sink in the first direction, and is configured to discharge heat dissipated from the second heat sink out of the second induction heating module.

In some implementations, the induction heating device may further include: a third induction heating module located within the casing, wherein the first induction heating module and the third induction heating module are arranged in a second direction perpendicular to the first direction; a third heat sink located vertically below the third induction heating module and configured to discharge heat from the third induction heating module; and a second heat pipe that passes through the third heat sink, that extends outward from the third induction heating module, and that is configured to discharge heat from the third heat sink out of the third induction heating module. In some examples, each of the first heat pipe and the second heat pipe extends in the first direction, and the first heat pipe and the second heat pipe are spaced apart from each other in the second direction. In some examples, the second heat pipe has an end that protrudes from the third induction heating module and that is located at the air-flow path between the cooling fan and the air-discharge fan.

In some implementations, the induction heating device further includes a cover plate that is configured to couple to a top of the casing, that is configured to provide a seal to the casing, and that is configured to seat an object to be heated. In some implementations, the induction heating device further includes a guide that is located between the air-discharge fan and the cooling fan, that defines the air-flow path, and that extends in the second direction. In some examples, the guide is located vertically above the first heat pipe and the second heat pipe, and the first heat pipe and the second heat pipe protrude outward from the guide in the first direction.

In some implementations, the cooling fan is configured to blow air to the air-discharge fan in the second direction, and the air-discharge fan is configured to discharge air in a third direction that is perpendicular to each of the first direction and the second direction. In some implementations, the first heat pipe includes a plurality of heat pipes that extend through the first induction heating module. In some examples, the first heat sink includes a plurality of heat sinks, each of which is located vertically above a heat pipe among the plurality of heat pipes.

In some implementations, the first heat pipe includes a plurality of heat pipes that extend through the first induction heating module and the second induction heating module in the first direction. In some examples, the first heat pipe may include a plurality of first heat pipes that are spaced apart from each other in the second direction and that extend through the first induction heating module and the second induction heating module in the first direction. The second heat pipe may include a plurality of second heat pipes that are spaced apart from each other in the second direction and that extend through the third induction heating module in the first direction.

The purposes of the present disclosure are not limited to the above-mentioned purposes. Other purposes and advantages of the present disclosure, as not mentioned above, may be understood from the following descriptions and more clearly understood from the implementations of the present disclosure. Further, it will be readily appreciated that the objects and advantages of the present disclosure may be realized by features and combinations thereof as disclosed in the claims.

Further specific effects of the present disclosure as well as the effects as described above will be described with illustrations of specific details of various implementations.

DETAILED DESCRIPTION

Hereinafter, an inductive-heating device according to one implementation of the present disclosure is illustrated.

Figure 1:
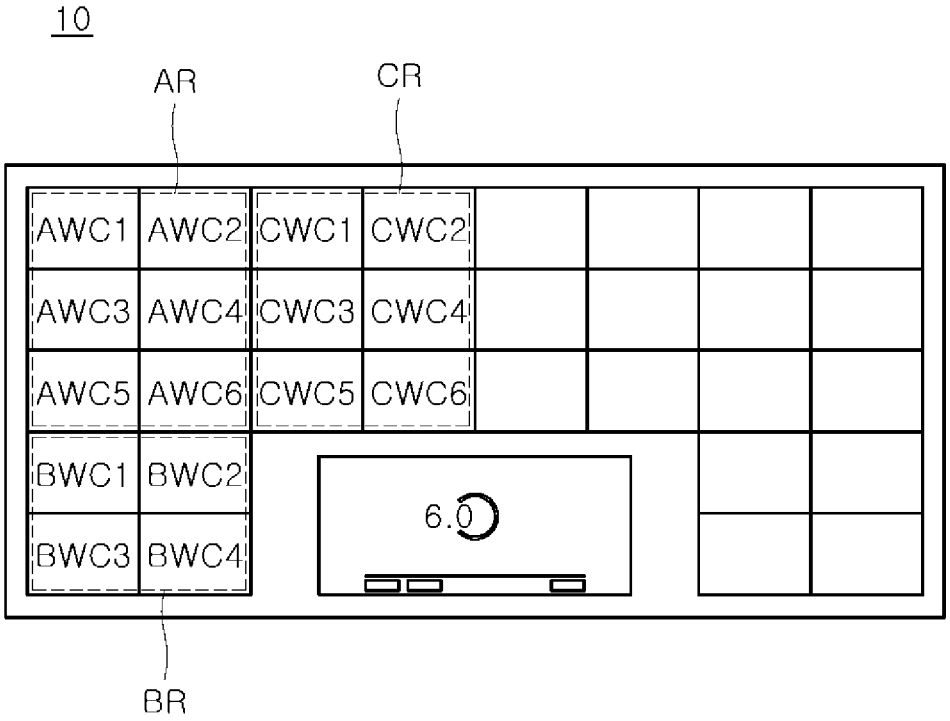
FIG. 1 RELATED ART
FIG. 1 is a schematic diagram illustrating a zone-free based inductive-heating device of related art.
Figure 2:
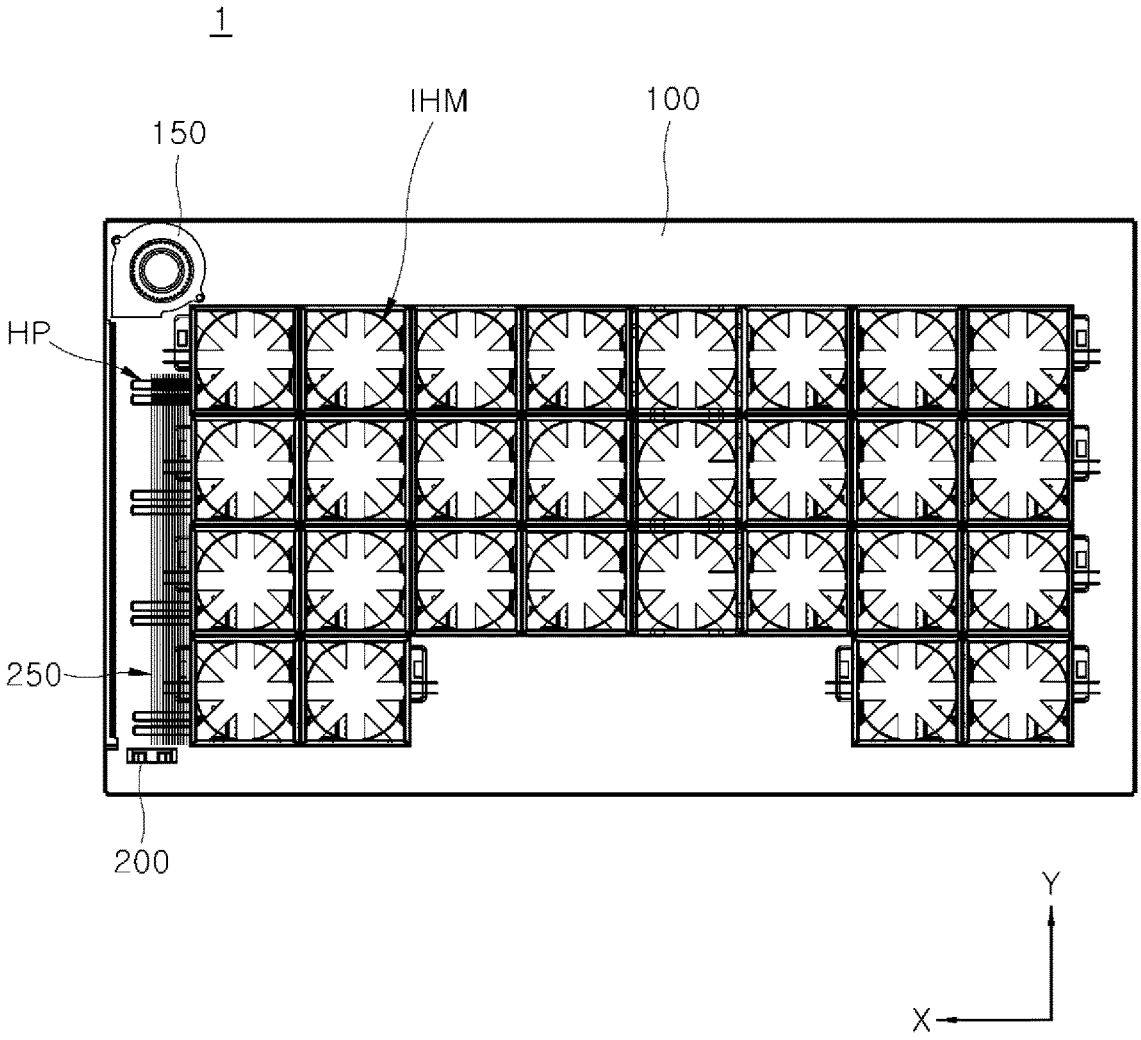
FIG. 2 is a top view illustrating an example induction heating device according to one implementation of the present disclosure.
Figure 3:
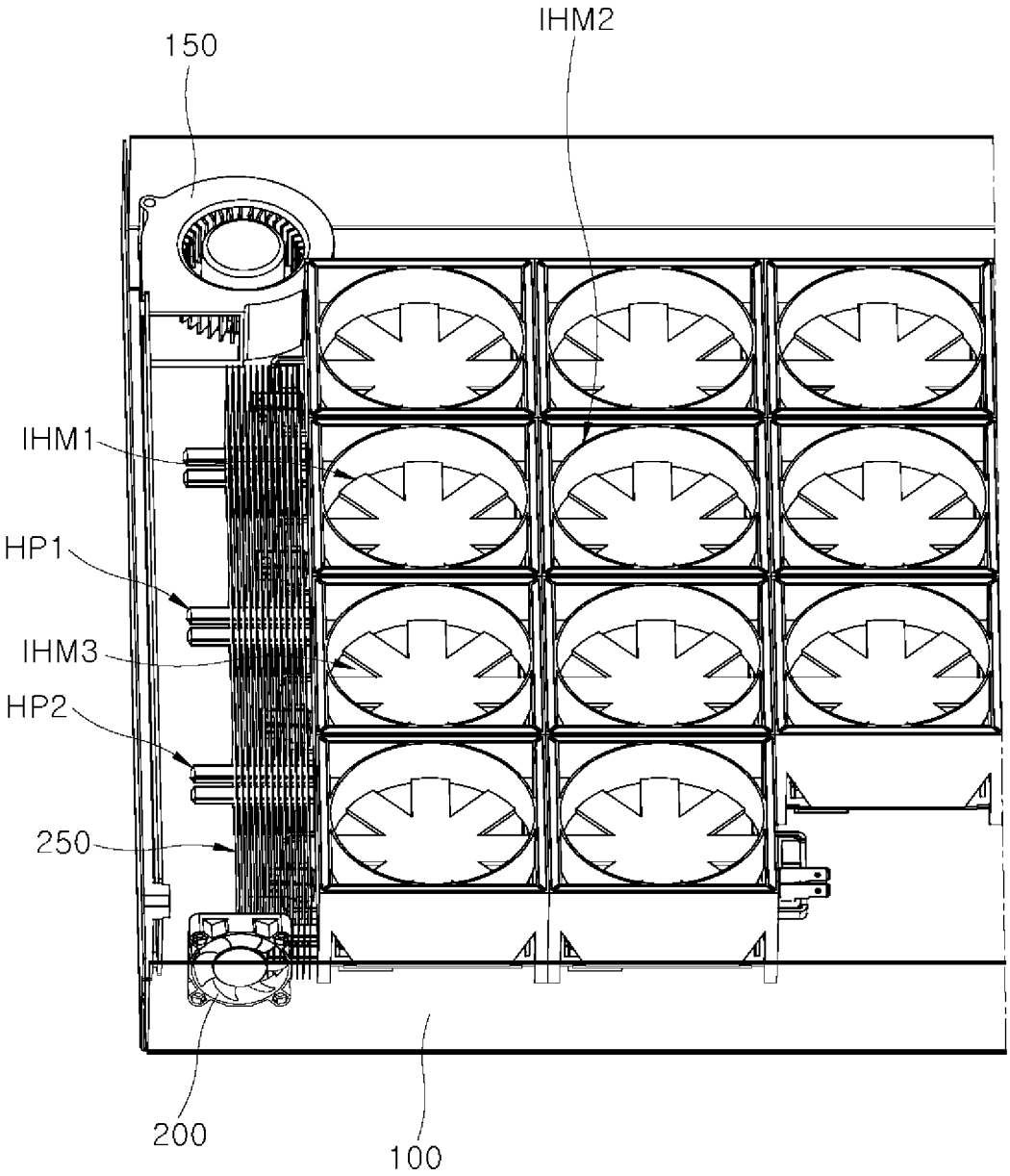
FIG. 3 is a perspective view illustrating an example portion of the induction heating device of FIG. 2.
Figure 4:
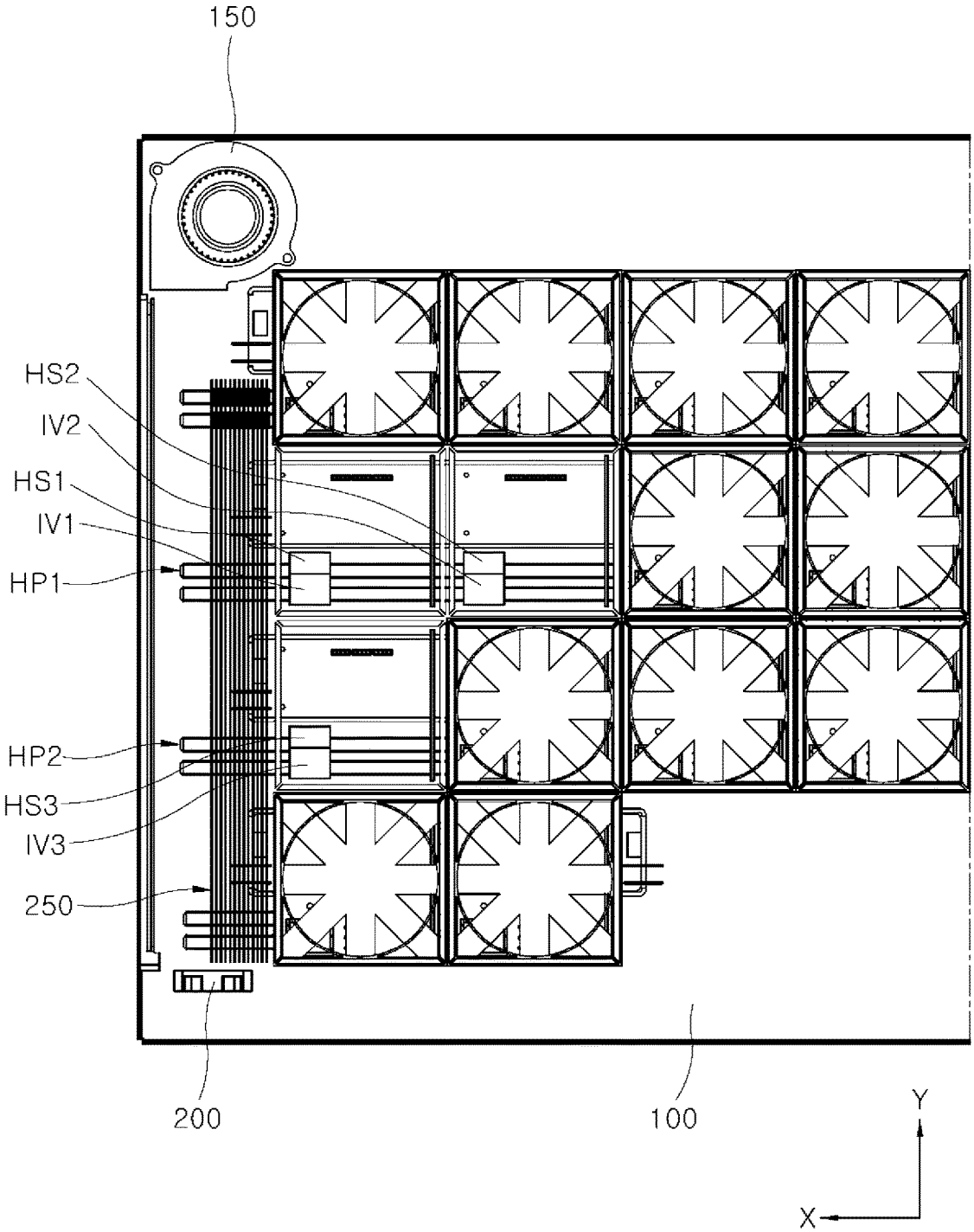
FIG. 4 is a top view corresponding to FIG. 2.
Figure 5:
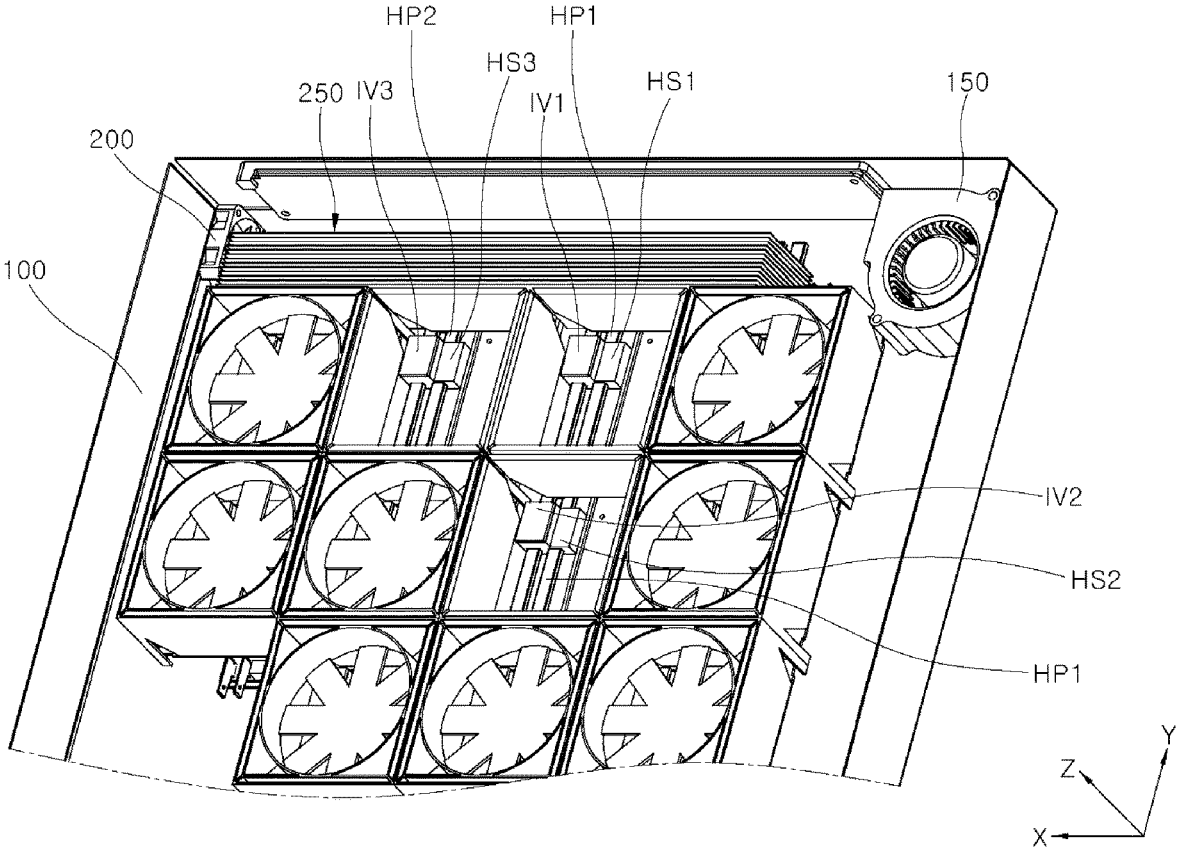
FIG. 5 is a perspective view of FIG. 4 viewed at a different angle.
Figure 6:
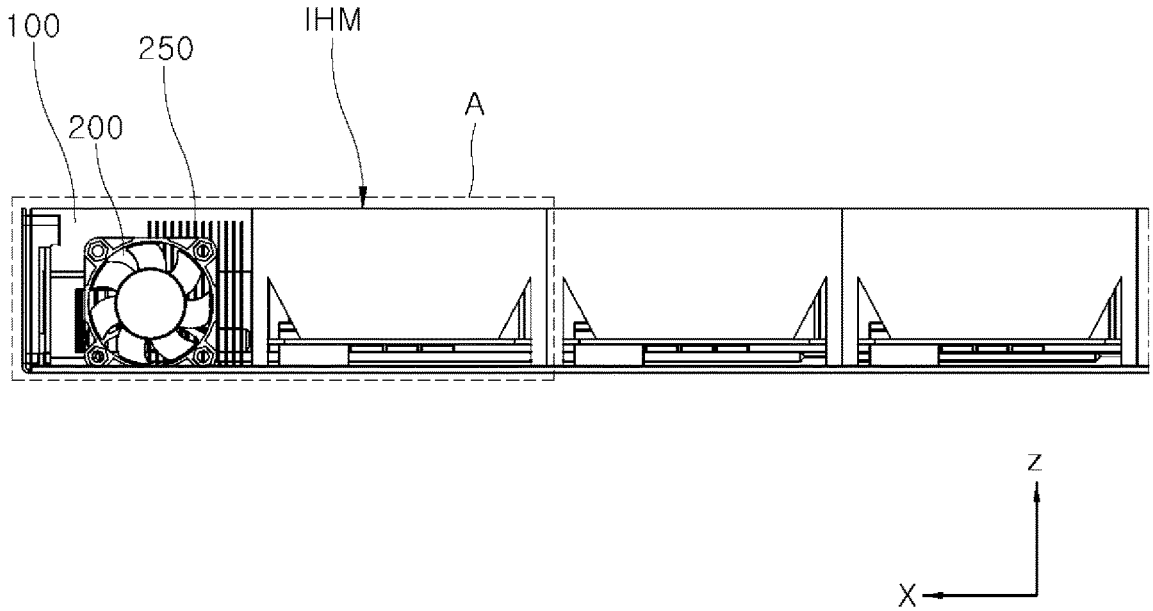
FIG. 6 is a front view of the induction heating device of FIG. 2.
Figure 7:
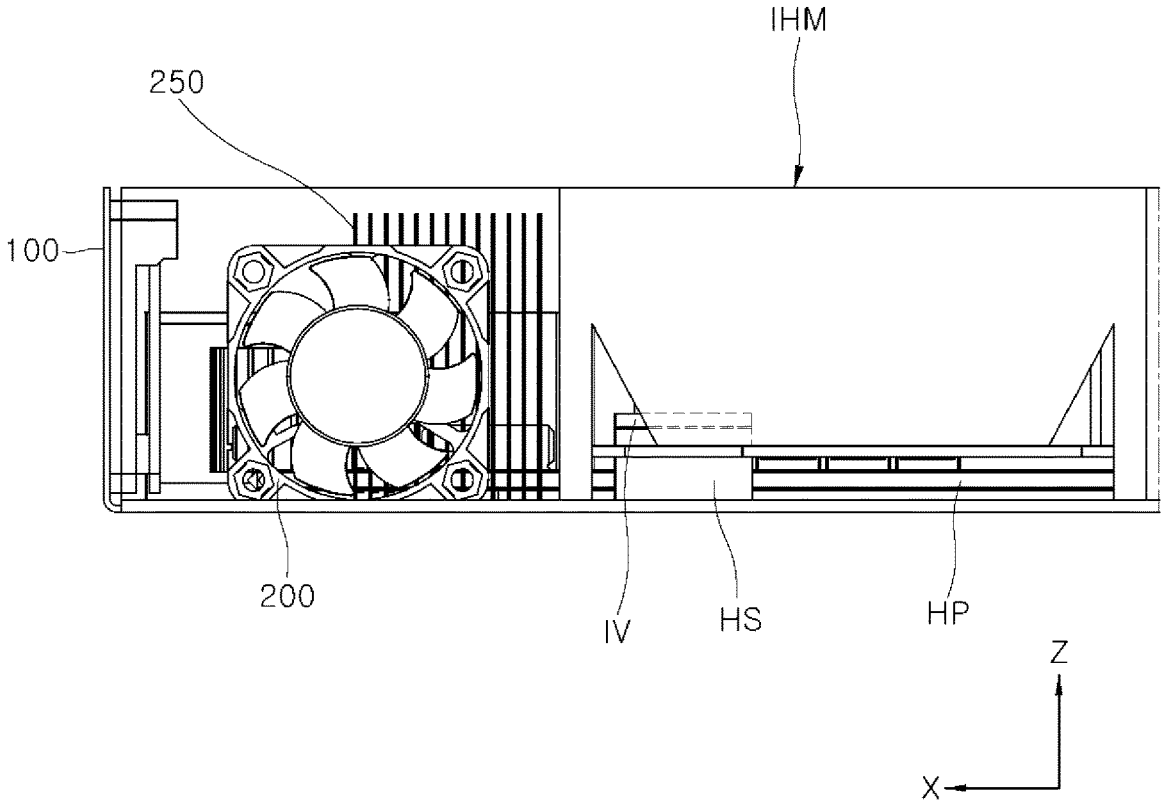
FIG. 7 is an enlarged view of a portion A of FIG. 6.

FIG. 2 is a top view illustrating an example induction heating device according to one implementation of the present disclosure. FIG. 3 is a perspective view illustrating a portion of the induction heating device of FIG. 2. FIG. 4 is a top view corresponding to FIG. 2, with some components thereof being omitted. FIG. 5 is a perspective view of FIG. 4 taken at a different angle. FIG. 6 is a front view of the induction heating device of FIG. 2. FIG. 7 is an enlarged view of a portion A of FIG. 6.

Referring first to FIG. 2, the example induction heating device 1 includes a casing 100, a cover plate, a plurality of induction heating modules (IHMs in following figures), a plurality of heat pipes (HPs in following figures), a plurality of heat sinks (HSs in following figures: for example, HS1 to HS3 in FIG. 4), an air-discharge fan 150, a cooling fan 200 and a blowing-guide 250.

In some implementations, the numbers of the induction heating modules IHM, heat pipes HP, heat sinks, air-discharge fans 150, cooling fans 200, and blowing-guides 250 as shown in FIG. 2 may vary depending on the size of casing 100, or a device performance. However, for convenience of illustration, the number of each component as shown in FIG. 2 will be exemplified.

The casing 100 houses therein the various components constituting the induction heating device 1, such as the plurality of induction heating modules (IHMs in following figures), the plurality of heat pipes (HPs in following figures), the plurality of heat sinks (HSs in following figures: for example, HS1 to HS3 in FIG. 4), the air-discharge fan 150, the cooling fan 200 and the blowing-guide 250.

Further, although not shown in the drawing, the casing 100 may further house a power supply that supplies power to various components such as the induction heating module IHM, the air-discharge fan 150, and the cooling fan 200. A cover plate may be coupled to a top of the casing 100.

Each of the multiple induction heating modules IHMs may be individually connected to each power supply. Alternatively, in one implementation of the present disclosure, a single power supply that supplies power to the various components in common may be installed in the casing 100. The latter will be described below.

Further, the cover plate is coupled to an upper end of the casing 100 to seal an inside of the casing 100. A loaded-object may be disposed on a top face of the cover plate. The cover plate may include a loading plate for loading thereon a loaded-object, such as a cooking vessel.

In this connection, the loading plate may be made of, for example, a glass material. The loading plate may include an input interface that receives input from a user and transfers the input to a control unit as described below.

In some implementations, the input interface transfers the input provided from the user not to a control unit (that is, a control unit for the induction heating module IHM) as described later, but to a control unit for the input interface. The input interface control unit may transmit the input to the control unit, which will be described later. The details of this will be omitted.

Further, heat generated from the induction heating module IHM may be transferred through the loading plate to the loaded-object thereon. In addition, the casing 100 may be thermally insulated to prevent the heat generated by the induction heating module IHM from leaking to the outside.

Each of the induction heating modules IHMs may be a stand-alone module that is independently driven. Each module may be installed inside the casing 100.

Thus, although not shown in the drawings, each induction heating module IHM may include a working coil. The module may include units associated with an operation of the working coil, for example, a rectifier for rectifying AC power from the power supply to DC power, an inverter for converting the DC power rectified by the rectifier into a resonant current via a switching operation and for providing the converted current to the working coil, a control unit for controlling operations of various components in the induction heating module, and a relay or a semiconductor switch that turns on or off the working coil. The module IHM may include a light emitting unit (also referred to as an indicator, installed around the working coil, and indicating whether the working coil is driven, and indicating an output intensity thereof). Specific examples of these components will be omitted.

In some implementations, the induction heating module IHM includes a plurality of induction heating module IHMs. The plurality of induction heating modules (e.g., IHMs) may be arranged in a first direction (i.e., an X-axis direction X) and a second direction (i.e., a Y-axis direction Y perpendicular to the X-axis direction X).

In some implementations, each of the plurality of induction heating modules may be independently driven. In this way, a corresponding working coil provided in a corresponding heating model may also be controlled independently.

The heat sink may be installed under the induction heating module IHM. The heat sink dissipates heat from the induction heating module IHM. The heat pipe HP discharges the heat dissipated from the heat sink to the outside of the induction heating module IHM. To this end, the heat pipe extends through the heat sink outside the induction heating module IHM. Details of those configurations will be described later.

The air-discharge fan 150 is installed at the one end of an inner edge of the casing 100. The air-discharge fan 150 may discharge air inside the casing 100 to the outside of the casing 100. The cooling fan 200 is installed inside the casing 100 at the other end of the inner edge. The one end is opposite to the other end. The cooling fan 200 blows air to the air-discharge fan 150.

Specifically, the air-discharge fan 150 may suck the discharged air or wind from the cooling fan 200 and discharge the air or wind to the outside of the casing 100.

In this connection, the air discharged from the cooling fan 200 may be guided by the blowing-guide 250 and may be transmitted to the air-discharge fan 150. The air guided by the blowing-guide 250 may flow while cooling the heat of the heat pipe HP.

That is, as shown in FIG. 2, one end of the heat pipe HP protruding out of the induction heating module IHM may be disposed on an air-flow path between the cooling fan 200 and the air-discharge fan 150. Thereby, the air guided by the blowing-guide 250 may flow while cooling the heat pipe HP.

In some implementations, the cooling fan 200 and the air-discharge fan 150 are respectively installed at the opposite ends of the inner edge of the casing 100. The cooling fan 200 and the air-discharge fan 150 are not provided for each of the plurality of induction heating modules, but are provided commonly for the plurality of induction heating modules. This makes it possible to reduce the number of cooling-fans and air-discharge fans.

In some implementations, the cooling fan 200 and the air-discharge fan 150 are respectively installed at an inner edge at the opposite ends of the inner edge of the casing 100. An available inner space in the casing 100 may increase.

In some implementations, although not shown in the drawing, when the induction heating device 1 further includes an additional cooling fan and an additional air-discharge fan. In this case, the additional cooling fan and the additional air-discharge fan may be respectively installed at opposite ends of a further inner edge which is far away from the cooling fan 200 and the air-discharge fan 150 shown in FIG. 2, inside the casing 100.

In some implementations, the blowing-guide 250 may extend between the air-discharge fan 150 and the cooling fan 200 in the second direction Y perpendicular to the first direction X, thereby to define an air-flow path. In some implementations, the blowing-guide 250 may include a plurality of plates extending in the second direction Y. The plates may be spaced apart in the first direction X. The number of the plurality of plates may vary. Details of this will be described later.

In some implementations, the induction heating device 1 may also have a wireless power transfer function, based on the configurations and features described above.

For example, the induction heating device 1 may utilize a technology for supplying power wirelessly. An electronic device with the wireless power transmission technology may charge a battery by simply placing the battery on a charging pad without connecting the battery to a separate charging connector. An electronic device to which such a wireless power transmission is applied does not require a wire cord or a charger, so that portability thereof is improved and a size and weight of the electronic device are reduced compared to the prior art.

Such a wireless power transmission system may include an electromagnetic induction system using a coil, a resonance system using resonance, and a microwave radiation system that converts electrical energy into microwave and transmits the microwave. The electromagnetic induction system uses an electromagnetic induction between a primary coil provided in a unit for transmitting wireless power (for example, a working coil) and a secondary coil included in a unit for receiving the wireless power.

The induction heating device 1 may heat the loaded-object via electromagnetic induction. Thus, the operation principle of the induction heating device 1 may be substantially the same as that of the electromagnetic induction-based wireless power transmission system.

In this regard, in some implementations, the induction heating device 1 may have the wireless power transmission function as well as induction heating function.

In some implementations, an induction heating mode or a wireless power transfer mode may be controlled by the control unit for the induction heating module (or the control unit for the input interface). In some examples, the induction heating function or the wireless power transfer function may be selectively used.

In some implementations, the induction heating device 1 may one or more of the features and configurations as described above.

Hereinafter, the features and configuration of the induction heating device 1 will be described in more detail with reference to FIGS. 3 to 7.

In some implementations, for convenience of illustration, first to third induction heating modules IHM1 to IHM3, first and second heat pipes HP1 and HP2, and first to third heat sinks HS1 to HS3 will be exemplified.

Specifically, the second induction heating module IHM2 and the first induction heating module IHM1 may be arranged in the casing 100 in the first direction X. The third induction heating module IHM3 and the first induction heating module IHM1 may be arranged in the casing 100 in the second direction Y. The first induction heating module IHM1 may be adjacent to each of the second induction heating module IHM2 and the third induction heating module IHM3.

In some implementations, under the first induction heating module IHM1, the first heat sink HS1 is installed which dissipates the heat from the first induction heating module IHM1. Under the second induction heating module IHM2, there is installed the second heat sink HS2 for dissipating the heat from the second induction heating module IHM2. Under the third induction heating module IHM3, the third heat sink HS3 is installed, which dissipates the heat from the third induction heating module IHM3.

In this connection, a thermal grease may be applied on each of the first to third heat sinks HS3 to facilitate heat transfer.

More specifically, the first induction heating module IHM1 may include a first inverter IV1 for applying a resonant current to a first working coil provided therein. The first inverter IV1 may apply a resonant current to the first working coil via switching operations of first and second switching elements included therein.

In some implementations, each of the first and second switching elements may include an insulated gate bipolar transistor (IGBT). The first heat sink HS1 may be installed below the first inverter IV1, i.e. below the first and second switching elements.

In some implementations, the second induction heating module IHM2 may include a second inverter IV2 for applying a resonant current to a second working coil provided therein. The second inverter IV2 may apply a resonant current to the second working coil via switching operations of third and fourth switching elements included therein.

In some implementations, each of the third and fourth switching elements may include an insulated gate bipolar transistor (IGBT). The second heat sink HS2 may be installed below the second inverter IV2, i.e. below the third and fourth switching elements.

Moreover, the third induction heating module IHM3 may include a third inverter IV3 for applying a resonant current to a third working coil provided therein. The third inverter IV3 may apply a resonant current to the third working coil via switching operations of fifth and sixth switching elements provided therein.

In some implementations, each of the fifth and sixth switching elements may include an IGBT (insulated gate bipolar transistor). The third heat sink HS3 may be installed below the third inverter IV3, i.e., below the fifth and sixth switching elements.

In some implementations, the first heat pipe HP1 passes through the first heat sink HS1 and extends out of the first induction heating module IHM1 in order to discharge the heat dissipated from the first heat sink HS1 to the outside of the first induction heating module IHM1. In some implementations, the first heat pipe HP1 passes through the second heat sink HS2 and extends out of the second induction heating module IHM2 in order to discharge the heat dissipated from the second heat sink HS2 to the outside of the second induction heating module IHM2.

For example, the first heat pipe HP1 may extend through the first and second heat sinks HS1 and HS2 to extend in the first direction X.

In some implementations, the second heat pipe HP2 may pass through the third heat sink HS3 and extend outside the third induction heating module IHM3 in order to discharge the heat dissipated from HS3 out of the third induction heating module IHM3.

For example, the second heat pipe HP2 may extend through the third heat sink HS3 to extend in the first direction X.

In some implementations, each of the first and second heat pipes HP1 and HP2 extend in the first direction X while the first and second heat pipes HP1 and HP2 may be spaced from each other in the second direction Y. In some implementations, each of the first and second heat pipes HP1 and HP2 may include two pipes to cover an area of the corresponding heat sink, as shown in the figure. The present disclosure is not limited thereto.

In some implementations, each of the first and second heat pipes HP1 and HP2 may penetrate the blowing-guide 250 in the first direction X.

For example, as shown in FIG. 6 and FIG. 7, each of the heat pipes HPs extending in the first direction X penetrates the blowing-guide 250 in the first direction X.

In some implementations, the heat pipe HP extends in the first direction X and passes through side faces of the blowing-guide 250 such as side faces of the plurality of plates. This allows heat transfer between the blowing-guide 250 and the heat pipe HP. In some examples, a cross-sectional area, which discharged air from the cooling fan 200 contacts, may be greater in a case where the heat pipe HP and the blowing-guide 250 are provided than a case where the heat pipe HP is only provided. That is, the contact cross-sectional area increases due to the plurality of plates. As described above, the cooling efficiency by the cooling fan 200 may be improved.

In some implementations, each of the plurality of plates extends in the second direction (Yin FIG. 4), as described above. Each of the plurality of plates may be erected in a third direction (i.e., the Z-axis direction Z orthogonal to a plane (X, Y) defined by the X-axis and the Y-axis). However, a dimension in the third direction Z of each of the plurality of plates may be set to be lower than a dimension in the third direction Z of the casing 100.

As described above, in some implementations, each of the plurality of working coils may be independently controlled, thereby allowing the operation of each of the working coils to be finely controlled. By finely controlling the operation of each of the working coils, the heating region may also be finely controlled, which may improve user satisfaction.

In some implementations, the plurality of IGBTs may be efficiently cooled, thereby solving the product heating problem. Further, solving the heat generation problem of the product may allow preventing the product damage problem as otherwise caused by the heat generation.

In some implementations, the number of cooling-fans may be reduced, thereby achieving a wider available space in the casing. Further, when the induction heating device 1 is a built-in product, a manufacturer or manufacturing company may have flexibility in selection of the installation location of the cooling fan since the required number of the cooling-fans may be reduced.

In the above description, numerous specific details are set forth in order to provide a thorough understanding of the present disclosure. The present disclosure may be practiced without some or all of these specific details. Examples of various implementations have been illustrated and described above. It will be understood that the description herein is not intended to limit the claims to the specific implementations described. On the contrary, it is intended to cover alternatives, modifications, and equivalents as may be included within the spirit and scope of the present disclosure as defined by the appended claims.

What is claimed is:

1. An induction heating device comprising:

a casing;

a first induction heater located within the casing;

a first heat sink located vertically below the first induction heater and configured to dissipate heat from the first induction heater;

a first heat pipe that passes through the first heat sink, that extends outward from the first induction heater, and that is configured to discharge heat from the first heat sink out of the first induction heater;

an air-discharge fan located at an inner side of the casing and configured to discharge air from inside of the casing to outside of the casing;

a cooling fan located at the inner side of the casing and configured to blow air to the air-discharge fan, the cooling fan being spaced apart from the air-discharge fan at the inner side; and a blowing-guide that includes a plurality of plates and that is located between the air-discharge fan and the cooling fan, wherein the first heat pipe passes through side surfaces of the plurality of plates of the blowing-guide, wherein the first heat pipe has an end that protrudes from the first induction heater to the blowing-guide in a first direction such that the protruded end of the first heat pipe is located between the cooling fan and the air-discharge fan, and wherein the plurality of plates are spaced from each other in the first direction to thereby define a plurality of air-flow paths extending along the blowing-guide from the cooling fan to the air-discharge fan in a second direction that is orthogonal to the first direction.

2. The induction heating device of claim 1, wherein the first heat sink comprises thermal grease.

3. The induction heating device of claim 1, wherein the first induction heater includes:

a working coil; and an inverter comprising a first switching element and a second switching element that are located vertically above the first heat sink and that are configured to allow the working coil to receive a resonant current, and wherein the inverter is configured to apply the resonant current to the working coil based on switching operations of the first switching element and the second switching element.

4. The induction heating device of claim 3, wherein each of the first switching element and the second switching element includes an insulated gate bipolar transistor (IGBT).

5. The induction heating device of claim 1, wherein the first heat sink is configured to transfer heat generated from the first induction heater to the first heat pipe, and wherein the cooling fan is configured to cool heat transferred to the first heat pipe.

6. The induction heating device of claim 1, further comprising:

a second induction heater located within the casing, wherein the first induction heater and the second induction heater are arranged in the first direction; and a second heat sink located vertically below the second induction heater and configured to discharge heat from the second induction heater.

7. The induction heating device of claim 6, wherein the first heat pipe extends to the second heat sink in the first direction, and is configured to discharge heat dissipated from the second heat sink out of the second induction heater.

8. The induction heating device of claim 6, further comprising:

a third induction heater located within the casing, wherein the first induction heater and the third induction heater are arranged in the second direction;

a third heat sink located vertically below the third induction heater and configured to discharge heat from the third induction heater; and a second heat pipe that passes through the third heat sink, that extends outward from the third induction heater, and that is configured to discharge heat from the third heat sink out of the third induction heater.

9. The induction heating device of claim 8, wherein each of the first heat pipe and the second heat pipe extends in the first direction, and wherein the first heat pipe and the second heat pipe are spaced apart from each other in the second direction.

10. The induction heating device of claim 8, wherein the second heat pipe has an end that protrudes from the third induction heater such that the protruded end of the second heat pipe is located between the cooling fan and the air-discharge fan.

11. The induction heating device of claim 8, wherein the blowing-guide extends in the second direction.

12. The induction heating device of claim 11, wherein the blowing-guide is located vertically above the first heat pipe and the second heat pipe, and wherein the first heat pipe and the second heat pipe protrude outward from the blowing-guide in the first direction.

13. The induction heating device of claim 9, wherein the cooling fan is configured to blow air to the air-discharge fan in the second direction, and wherein the air-discharge fan is configured to discharge air in a third direction that is perpendicular to each of the first direction and the second direction.

14. The induction heating device of claim 1, wherein the first heat pipe comprises a plurality of heat pipes that extend through the first induction heater.

15. The induction heating device of claim 14, wherein the first heat sink comprises a plurality of heat sinks, each heat sink being located vertically above a heat pipe among the plurality of heat pipes.

16. The induction heating device of claim 6, wherein the first heat pipe comprises a plurality of heat pipes that extend through the first induction heater and the second induction heater in the first direction.

17. The induction heating device of claim 8, wherein the first heat pipe comprises a plurality of first heat pipes that are spaced apart from each other in the second direction and that extend through the first induction heater and the second induction heater in the first direction, and wherein the second heat pipe comprises a plurality of second heat pipes that are spaced apart from each other in the second direction and that extend through the third induction heater in the first direction.

18. The induction heating device of claim 1, wherein the plurality of plates extend in a direction of an axis of the cooling fan.

19. The induction heating device of claim 1, wherein the first induction heater comprises an induction heating coil.

* * * * *